US006065725A

United States Patent [19]

Mason

[11] Patent Number: 6,065,725

[45] Date of Patent: May 23, 2000

[54] ADJUSTABLE RETAINING BRACKET

[75] Inventor: Timothy L Mason, Melville, N.Y.

[73] Assignee: NDR Corporation, Melville, N.Y.

[21] Appl. No.: 09/169,626

[22] Filed: Oct. 9, 1998

[51] Int. Cl.[7] ..... F04G 3/00

[52] U.S. Cl. ..... 248/292.11; 74/527; 74/541; 211/104; 248/292.12; 248/292.13

[58] Field of Search ..... 248/292.12, 292.13, 248/297.31, 292.11, 479, 292.14, 291.1; 312/319.2; 40/568, 564, 506; 74/527, 541; 211/104, 96

[56] References Cited

U.S. PATENT DOCUMENTS

| | | | |
|---|---|---|---|
| 747,442 | 12/1903 | Latshaw | 211/173 |
| 5,058,846 | 10/1991 | Close | 248/292.1 |
| 5,224,677 | 7/1993 | Close | 248/292.1 |
| 5,526,944 | 6/1996 | Merl | 211/87 |
| 5,788,349 | 8/1998 | Demaine et al. | 312/223.6 |
| 5,860,537 | 1/1999 | Loew | 211/104 |

*Primary Examiner*—Leslie A. Braun
*Assistant Examiner*—Naschica Sanders
*Attorney, Agent, or Firm*—Collard & Roe, P.C.

[57] ABSTRACT

An adjustable retaining bracket for securing a display panel to a stationary object. The invention provides a retaining bracket having a latching arm, with a rounded nose, pivotally connected to the bracket. The latching arm engages a corresponding latching pin located on a support arm. The support arm is secured to a display panel and pivotally attached to the mounting bracket using bolts. The invention is then secured to the existing store shelving using nuts and bolts. The latching arm contains at least one detent and is used to retain the display panel at a variety of viewing angles depending upon which detent engages the latching pin. When the display panel is rotated counterclockwise (toward the store shelving), the latching pin of the support arm engages the rounded nose of the latching arm, raises the arm and comes to rest in a detent position. Further movement of the sign will move the sign to the next detent position (if available). Rotation of the panel in the opposite direction will disengage the securing latch and allow the sign to swing freely to a downward vertical position.

7 Claims, 5 Drawing Sheets

ADJUSTABLE RETAINING BRACKET

BACKGROUND OF THE INVENTION

1. Field of the Invention

The present invention relates to an adjustable retaining bracket. In particular, the invention relates to a retaining bracket which retains overhead signs at a variety of angles thereby increasing the visibility of the sign and allows access to overstock product.

2. The Prior Art

In certain business environments, it is important to store additional stock in close proximity to the display. Fast selling merchandise must be continually restocked to keep the consuming public buying. Because these storage areas are generally in full view of the consuming public, store owners desire to maintain these areas in good order. In addition, the store owners need large signage so customers can immediately identify the location of the various products.

U.S. Pat. No. 5,788,349 to DeMaine discloses an overhead storage system with illuminated signage. The invention includes an overhead storage bin which is positioned above a work area. Flourescent lights attached below and on one side of the storage bin provide light for the work space as well as light for a transparent display sign. Merchandise is stored inside the bin via a hinged rear door. This device, however, has several drawbacks. In the first instance, the display panel is fixed at a certain viewing angle. If the storage bin is positioned above the heads of the consuming public, the signs may be difficult to read or go entirely unnoticed. In addition to the fixed display panel angle, the stored merchandise must be inserted from the rear. This limits the allowable positioning of the storage bin.

SUMMARY OF THE INVENTION

It is therefore an object of the present invention to provide an adjustable retaining bracket which retains a display panel at varying angles relative to the consumer.

It is a further object of the invention to provide an adjustable retaining bracket which is adaptable to a wide variety of display panels, either illuminated or not.

It is an additional object of the invention to provide an adjustable retaining bracket which is easily attached to existing shelving thereby providing storage behind the display panel.

It is another object of the invention to provide an adjustable retaining bracket which can disengage the display panel and allow for the rotation of the panel to a vertical downward position to provide easy access to stored merchandise.

To achieve these objects, the invention provides a retaining bracket having a latching arm, with a rounded nose, pivotally connected to the bracket. The latching arm engages a corresponding latching pin located on a support arm. The support arm is secured to a display panel and pivotally attached to the mounting bracket using bolts. The invention is then secured to the existing store shelving using nuts and bolts. The latching arm contains at least one detent and is used to retain the display panel at a variety of viewing angles depending upon which detent engages the latching pin. When the display panel is rotated counterclockwise (toward the store shelving), the latching pin of the support arm engages the rounded nose of the latching arm, raises the arm and comes to rest in a detent position. Further movement of the sign will move the sign to the next detent position (if available). Rotation of the panel in the opposite direction will disengage the latching arm and allow the sign to swing freely to a downward vertical position.

BRIEF DESCRIPTION OF THE DRAWINGS

Other objects and features of the present invention will become apparent from the following detailed descriptions considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
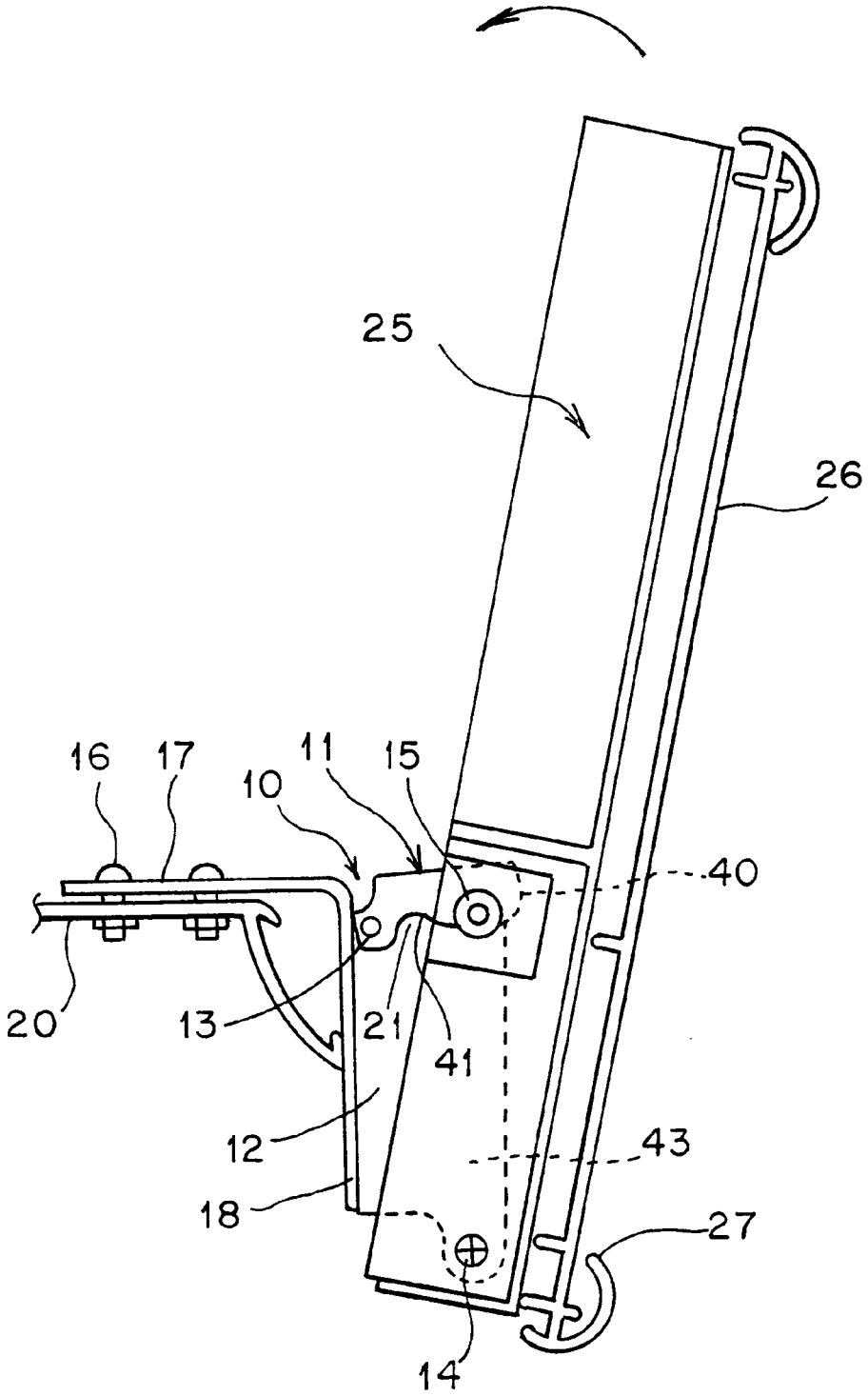
FIG. 1 is a side plan view of the invention connected to a display panel in a viewing position.

Turning now in detail to the drawings, FIG. 1 shows the invention 10 secured to a store shelf 20 via a plurality of mounting bracket fasteners 16. The invention 10 includes an L-shaped bracket having a securing plate 17 and a face plate 18, both rectangular in shape, and connected to each other at a 90° angle. In addition, a mounting plate 12 is similarly connected, at a 90° angle, to one of the long sides of face plate 18. Mounting plate 12 extends in a direction opposite from securing plate 17. Securing plate 17, face plate 18 and mounting plate 12 are preferably integrally formed out of any suitably strong material, preferably sheet metal.

A latching arm 11 is pivotally attached to a top end 42 of mounting plate 12 and has a rounded nose 40. Nose 40 is shaped so as to force latching arm 11 in a vertical direction when contacted by an object moving in a horizontal direction. Latching arm 11 swings in the same plane as bracket 12 and contains at least one detent 21. Latching arm 11 retains a supporting arm 25 in a variety of viewing angles which correspond to the number of detents 21 disposed on latching arm 11.

Supporting arm 25 is pivotally attached to a lower end 43 of mounting plate 12 via a display bolt 14. A latching pin 15 is secured to supporting arm 25 at a distance so as to contact nose 40 of latching arm 11 and raise arm 11 when supporting arm 25 is rotated toward shelving 20. Supporting arm 25 is then secured to a display panel 26. Panel 26 with supporting arm 25 is free to rotate about bolt 14. Latching pin 15 travels along a bottom edge 41 of latching arm 11 and comes to rest at one of a plurality of detents 21. As shown in FIG. 1, supporting arm 25 is secured in one of two detents 21. The support arm 25 is held at a downward angle, consequently, display panel 26 is also held at a downward angle. This angle is advantageous as the sign is easily viewable if located above the store customer.

Bracket 10 is preferably formed by bending a single L-shaped piece of metal in such a way as to have three rectangularly shaped faces which are preferably mutually perpendicular to each other. The metal piece is rectangular in shape with a tab located along the top side of the rectangle extending approximately half the length of the side thereby forming an L-shape. The rectangle is then folded along a center line so as to form a 90° angle. The tab is then bent away from the folded side forming a 90° angle. It is understood that bracket 10 may be constructed in a variety of different shapes while performing the same function.

Figure 2:
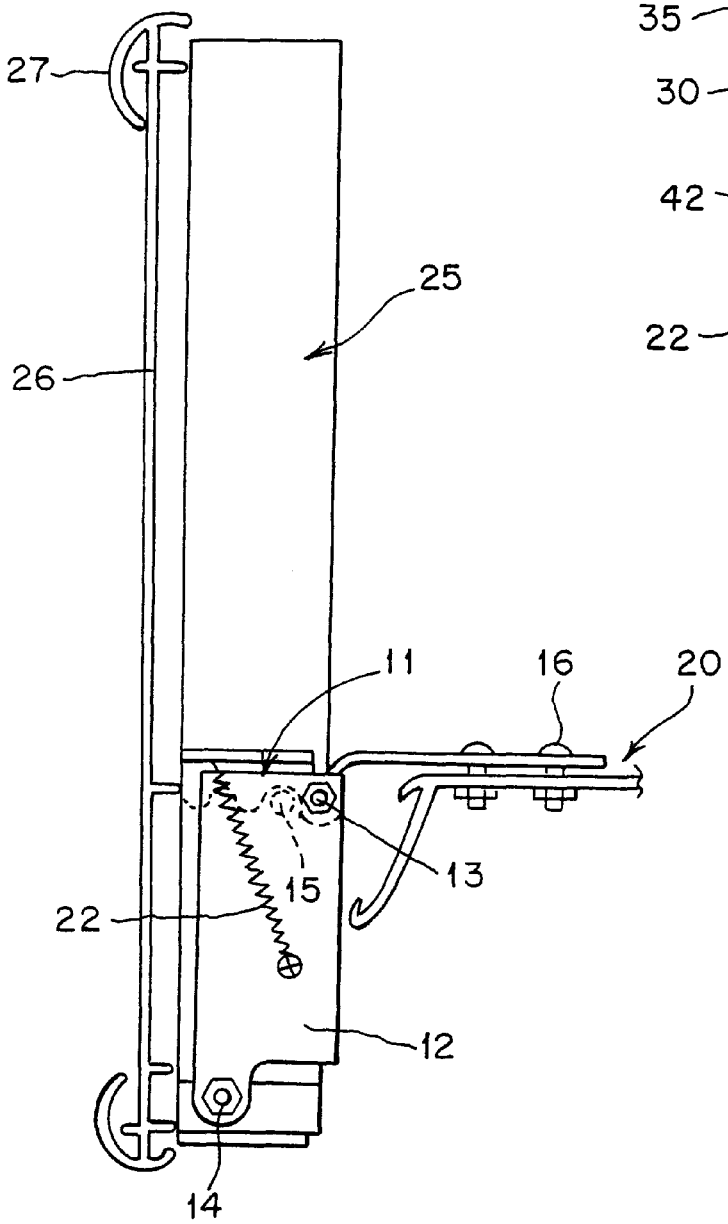
FIG. 2 is a side plan view of the invention connected to a display panel in vertical position.

FIG. 2 shows supporting arm 25 in the second detent 21. This detent retains supporting arm 25 in a vertical position. In addition, a spring 22 connected to arm 11, biases latching arm 11 in a downward position. The application of force to supporting arm 25 and display panel 26, in a direction away from shelving 20, will overcome spring bias 22 and cause latching pin 15 to travel along bottom edge 41 to any remaining detents 21. Eventually, latching pin 15 of supporting arm 25 will be free of latching arm 11 and rotate freely to a downward vertical position. This position is useful for restocking storage shelf 20. Spring 22 may be substituted with any known resilient elastic material.

Figure 3:
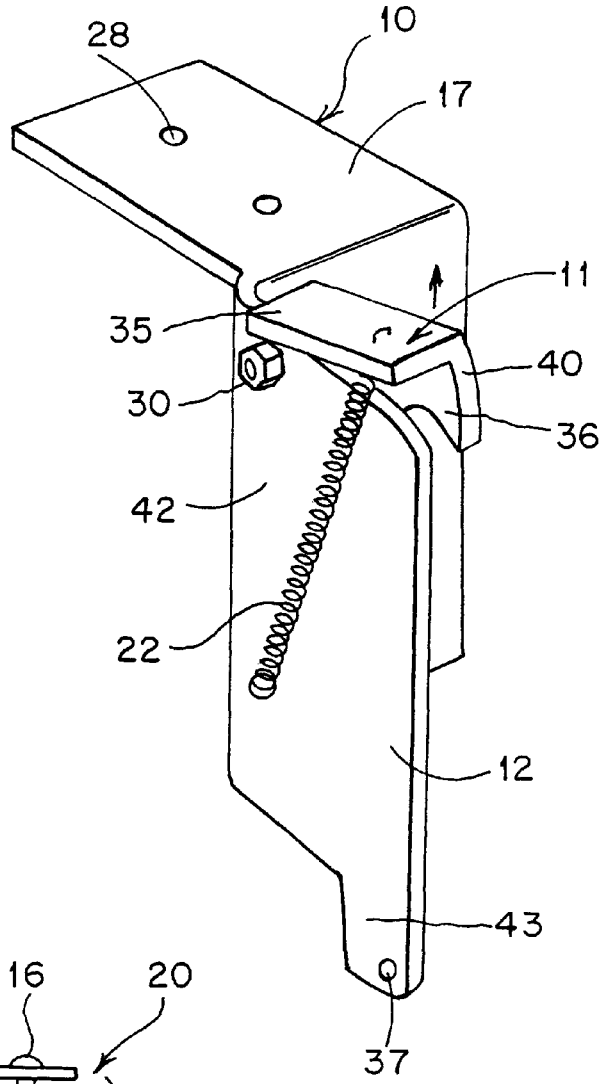
FIG. 3 i is a perspective view of the invention.

FIG. 3 is a perspective view of adjustable retaining bracket 10. Mounting plate 12 contains top end 42 and bottom end 43. Latching arm 11 is composed of a top side 35 and a detent side 36 connected to each other at a 90° angle. Detent side 36 has bottom edge 41. Latching arm 11 is biased in a downward direction via spring 22. Spring 22 is attached at one end to mounting plate 12 and at the other end to top side 35 of latching arm 11. A pivot hole 37 is disposed in bottom end 43 of mounting plate 12 and receives pivot bolt 14 which secures supporting arm 25 to mounting plate 12.

The spring 22 shown to urge latching arm 11 downward may be substituted by a coil spring that sits between arm 11 and nut 30 and is wound to pull latching arm 11 downward against the surface of mounting plate 12.

Figure 4:
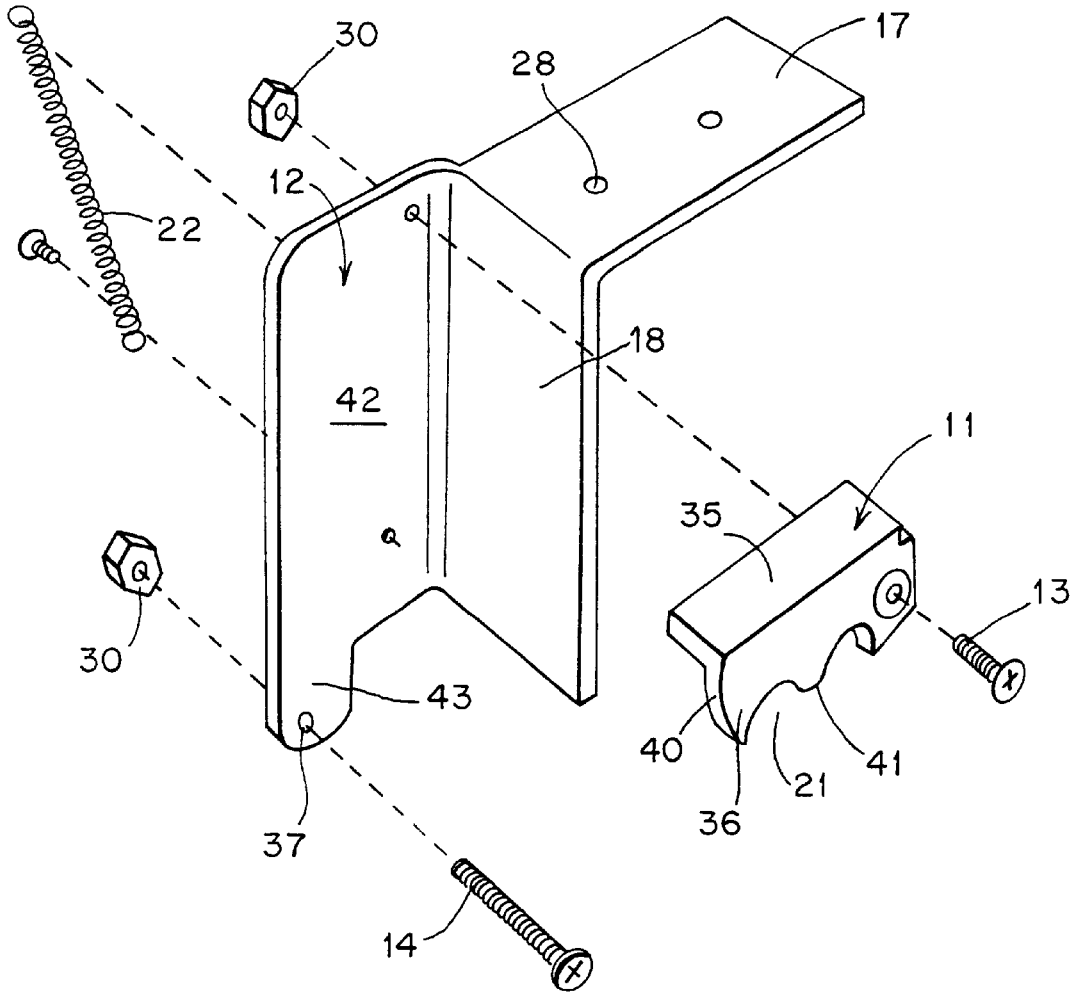
FIG. 4 is an exploded view of the invention.

Referring to FIG. 4, latching arm 11 is pivotally connected to top end 42 of mounting plate 12, near face plate 18, via a bolt 13 and a nut 30, and moves in the same plane as mounting plate 12. Top side 35 of latching arm 11 rests atop mounting plate 12 and prevents over-rotation.

A plurality of attachment holes 28 are punched through securing plate 17. Holes 28 receive screws to secure plate 17 to the existing store shelves. Pivot bolt 14 attaches supporting arm 25 (not shown) to mounting plate 12. Pivot bolt 14 is inserted through pivot hole 37 and secured with nut 30.

Figure 5:
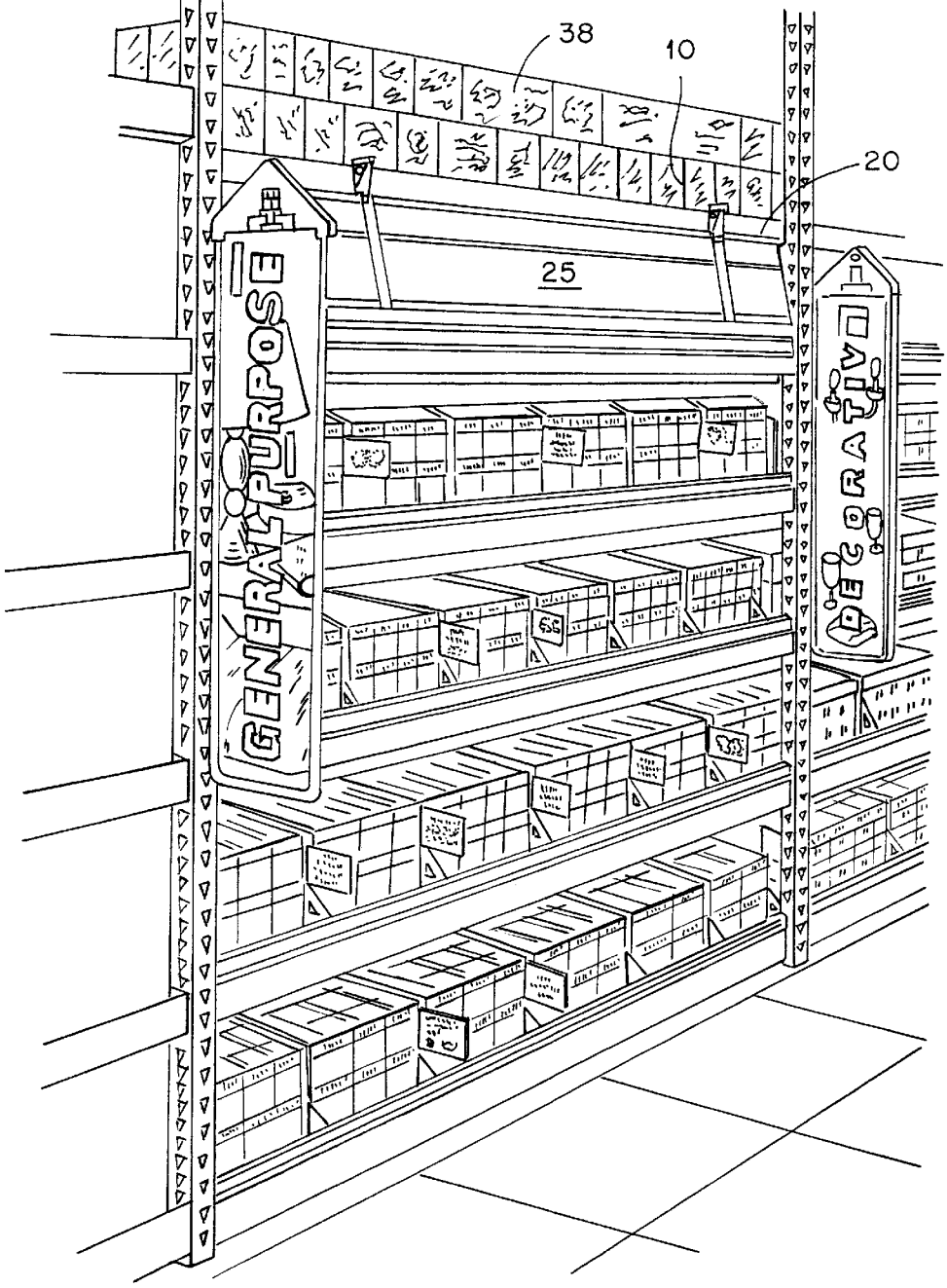
FIG. 5 is a perspective view of the invention connected to a display sign in a loading position.

Referring to FIG. 5, supporting arm 25 is rotated away from store shelving 20 and is not in contact with bracket 10. In this position, additional stored merchandise 38 is accessible for restocking the display.

Figure 6:
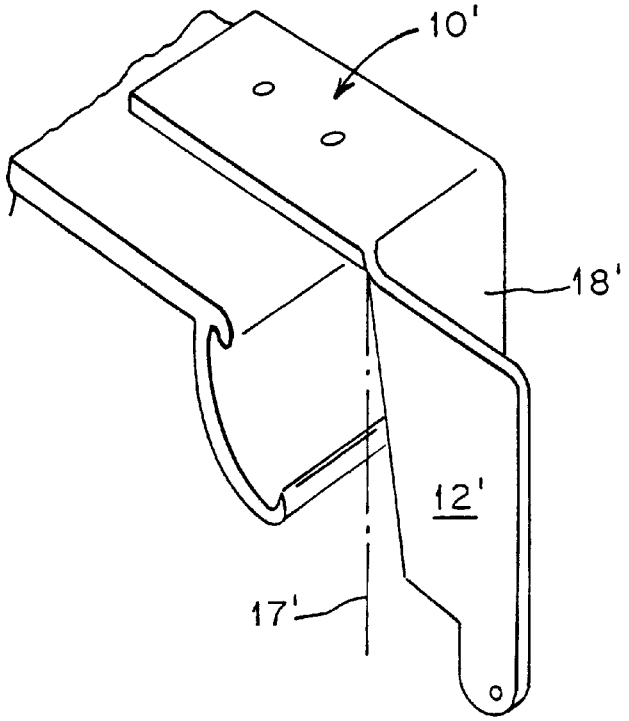
FIG. 6 is a perspective view of an alternate embodiment of the invention for attachment to shelves that are angled outward.

Referring to FIG. 6 there is shown another embodiment of a bracket 10' for mounting on shelves that are angled outward. In this embodiment bracket 10' has a mounting plate 12' which is not 90° from securing plate 17' but bent at an obtuse angle to accommodate for the projecting edge of the shelf. Likewise face plate 18' projects outwardly to accommodate the edge of the shelf.

Figure 7:
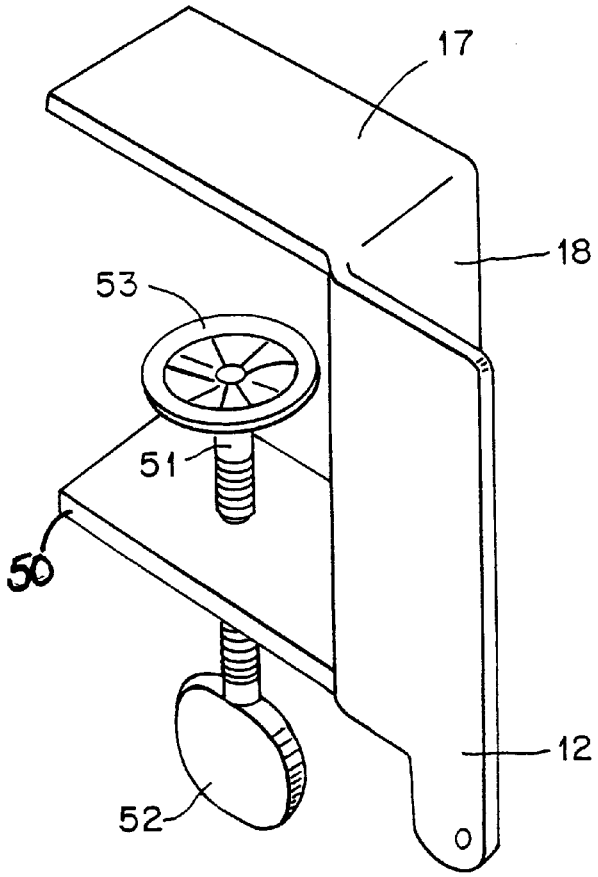
FIG. 7 is another embodiment of the invention for securing the bracket to shelves via a clamp.

FIG. 7 shows another embodiment of the bracket 10 having a horizontally extending plate 50 parallel to securing plate 17 for threadably receiving a thumbscrew 51 which forms part of a clamp. The thumbscrew also has a flat finger grip 52 at one end and a clamping surface 53 for clamping onto the bottom of the shelf instead of using the screw holes of the earlier embodiments.

Figure 8:
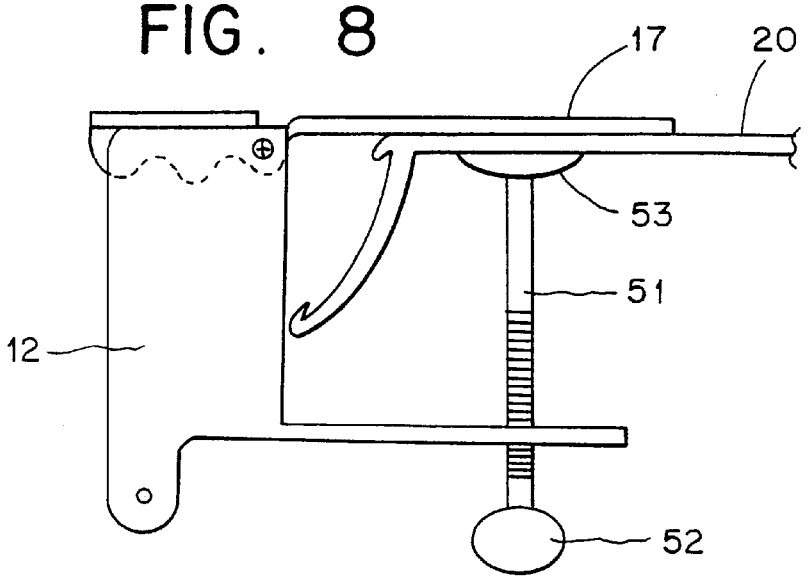
FIG. 8 is a side plan view of FIG. 7.

FIG. 8 shows a side plan view of bracket 10 with accompanying clamp. Rotation of thumbscrew 51 screws bracket 10 to shelf 20.

Accordingly, while several embodiments of the present invention have been shown and described, it is to be understood that many changes and modifications may be made thereunto without departing from the spirit and scope of the invention as defined in the appended claims.

What is claimed is:

1. An adjustable retaining bracket for securing a display panel to a stationary object, comprising:

an L-shaped bracket having a securing plate and a face plate connected to said securing plate;

a mounting plate connected to said face plate at an angle, said mounting plate extending in a plane perpendicular to said face plate and perpendicular to said securing plate, having a top end and a bottom end, said mounting plate, said securing plate, and said face plate form three mutually intersecting surfaces;

attachment means, disposed on said securing plate, for securing said securing plate to the stationary object;

at least one support arm having a latching pin, pivotally attached to said bottom end of said mounting plate and adapted to be secured the display panel;

at least one latching arm, pivotally connected to said top end of said mounting plate and moveable in the plane of said mounting plate, said latching arm having a round nose, a top side and a detent side connected at a 90° angle, said detent side having a bottom edge and at least one detent disposed on said detent side for engaging said latching pin, said top side resting on said mounting plate; and biasing means for maintaining said latching arm in a downward position toward said mounting plate.

2. The adjustable retaining bracket for securing a display panel to a stationary object according to claim 1, wherein said mounting plate, said securing plate and said face plate are integrally formed from a single piece of sheet metal.

3. The adjustable retaining bracket for securing a display panel to a stationary object according to claim 1, wherein said biasing means is a resilient spring having a first and a second end, said first end fixed to said mounting plate and said second end fixed to said latching arm.

4. The adjustable retaining bracket for securing a display panel to a stationary object according to claim 1, wherein said retaining bracket and said latching arm are made out of a strong, sheet metal.

5. The adjustable retaining bracket for securing a display panel to a stationary object according to claim 1, wherein said attachment means for securing said securing plate to the stationary object is a plurality of threaded bolts inserted through a plurality of holes disposed on said securing plate and a plurality of corresponding holes in the stationary object, said bolts secured by a plurality of nuts.

6. The adjustable retaining bracket for securing a display panel to a stationary object according to claim 1 wherein attachment means for securing plate to the stationary object comprises an adjustable clamping device.

7. The adjustable retaining bracket for securing a display panel to a stationary object according to claim 6, wherein said clamping device comprises a bolt, threadably coupled to a portion of the securing plate, a thumb piece formed at one end of said bolt and a clamping surface mounted on the opposite end of said bolt for contacting the stationary object.

* * * * *